US006788179B2

(12) United States Patent
Höller et al.

(10) Patent No.: US 6,788,179 B2
(45) Date of Patent: Sep. 7, 2004

(54) INDUCTIVE MINIATURE COMPONENT FOR SMD-MOUNTING AND METHOD FOR THE PRODUCTION THEREOF

(75) Inventors: Karl-Heinz Höller, Radevormwald (DE); Eugeniusz Swoboda, Iserlohn (DE)

(73) Assignee: Neosid Pemetzrieder GmbH & Co. KG (DE)

( * ) Notice: Subject to any disclaimer, the term of this patent is extended or adjusted under 35 U.S.C. 154(b) by 0 days.

(21) Appl. No.: 10/312,920

(22) PCT Filed: May 3, 2002

(86) PCT No.: PCT/DE02/01615

§ 371 (c)(1),
(2), (4) Date: Dec. 27, 2002

(87) PCT Pub. No.: WO02/095776

PCT Pub. Date: Nov. 28, 2002

(65) Prior Publication Data

US 2003/0141955 A1 Jul. 31, 2003

(30) Foreign Application Priority Data

May 18, 2001 (DE) ..... 101 24 378

(51) Int. Cl.[7] ..... H01F 27/02
(52) U.S. Cl. ..... 336/90
(58) Field of Search ..... 336/82, 90, 96, 336/98; 174/52.5, 52.1; 361/404

(56) References Cited

U.S. PATENT DOCUMENTS 4,754,370 A * 6/1988 DeTizio et al. ..... 361/772
5,212,345 A 5/1993 Gutierrez

FOREIGN PATENT DOCUMENTS

DE GM 7509610 3/1975
DE 19812836 9/1999

* cited by examiner

*Primary Examiner*—Chau N. Nguyen
(74) *Attorney, Agent, or Firm*—R W Becker & Associates; R W Becker

(57) ABSTRACT

An inductive miniature component for SMD-mounting with a coil support (1) formed of synthetic or ferrite material, in or on which is arranged at least one coil winding, whereby outwardly projecting connection pegs (1.1) are arranged on an outer side of the coil support and formed therewith as a single piece, each connection peg having several turns of an end (2.1) of a respective winding wire of a coil wire wound there around. A metallic wire winding (3.1) is disposed between the outer surface of the connection peg (1.1) and the winding wires (2.1), the metallic wire winding being comprised of an electrically conducting wire whose diameter is greater than the diameter of the winding wire and several turns of the metallic wire winding being directly wound on the connection peg (1.1).

13 Claims, 4 Drawing Sheets

INDUCTIVE MINIATURE COMPONENT FOR SMD-MOUNTING AND METHOD FOR THE PRODUCTION THEREOF

FIELD OF THE INVENTION

The invention relates to an inductive miniature component for SMD-mounting with a coil support formed of synthetic or ferrite material, in or on which coil support is arranged at least one coil winding, whereby outwardly projecting connection pegs are arranged on an outer side of the coil support and formed therewith as a single piece with each connection peg having several turns of an end of a respective winding wire of a coil wire wound therearound, as well as a method for producing a component of this type.

BACKGROUND OF THE INVENTION

An inductive miniature component of this type having a coil support comprised of a ferrite is described, for example, in German Utility Model Number 298 24 118.8.

In components of this type, the problem occurs with winding wires having very small diameters such as, for example, a diameter less than 0.08 mm, that the connection technology by which the end of the winding wire is secured by several turns around the connection peg becomes critical in view of the strength of the connection when subjected to a drop test and a vibration test. The danger exists that the ends of the thin winding wire are torn off in response to the loading thereof.

SUMMARY OF THE INVENTION

The invention provides a solution to the challenge of configuring an inductive miniature component for SMD-mounting with the features as set forth in the introductory portion and the principal concept of the patent claim 1 in such a manner that even with the deployment of winding wires having very thin diameters, the danger of a tearing off of the end of the winding wire is, even during shock vibration loading, considerably reduced.

The solution to this challenge succeeds, with reference to the component configured in accordance with the features set forth in the characterizing portion of the patent claim 1, in that a respective metallized wire winding comprised of an electrically conducting wire is disposed between each connection peg and the end of the winding wire wound therearound with the diameter of the electrically conducting wire being greater than the diameter of the winding wire and several turns thereof are wound directly on the connection peg. Advantageous modifications of the invention are described in the dependent claims as well as further described hereinafter in connection with the embodiment examples. A method for producing the inventive component is characterized by the following method steps:

a) positioning in readiness a coil support with outwardly projecting connection pegs;

b) winding of the connection pegs with several turns of a metallic wire winding, whereby the diameter of the wire is greater than the diameter of the winding wire;

c) disposition of a coil winding in the coil support;

d) removal of the lacquer insulation on the ends of the winding wire and, as the occasion arises, preliminarily applying tin to the ends;

e) winding of the connection pegs having the metallic wire winding wound therearound with several turns of the ends of the winding wire of the coil winding;

f) placing the coil support ends in contact with the connection pegs via dip brazing.

A further method for producing the inventive component is characterized by the following method steps:

a) positioning in readiness a coil support with outwardly projecting connection pegs;

b) winding of the connection pegs with several turns of a metallic wire winding, whereby the diameter of the wire is greater than the diameter of the winding wire;

c) disposition of at least one coil winding on the coil support;

d) removal of the lacquer insulation on the end of the winding wire and, as the occasion arises, preliminarily applying tin to the ends;

e) winding of the connection pegs having the metallic wire winding wound therearound with several turns of the ends of the winding wire of the coil winding;

f) placing the coil support ends in contact with the connection pegs via dip brazing.

The core concept of the invention lies in the fact that the respective ends of the winding wires are not directly wound on the connection pegs but, instead, the connection pegs are initially wound with several turns of a wire. Several turns of the ends of the winding wires are then wound around the metallic wire windings which have previously been wound on the connection pegs. Via the pre-applied winding onto each of the connection pegs of an electrically conducting wire of greater diameter, there are produced wide metallic surfaces which are similar to metallic connections. It has been shown that, in this manner, connections can be achieved which are mechanically substantially more stable than connections having the ends of the winding wires directly wound onto the connection pegs.

The diameter of the wire of the metallic wire winding should be sufficiently large that the wire's resistance to breakage under tension or tensile strength is sufficient to handle the impact loading and shake loading of the component. It has been shown that it is advantageous if the wire of the metallic wire winding has a diameter which is at least twice as great as the diameter of the winding wire.

The wire of the metallic wire winding can be a copper silver (CuAg) wire but can be, as well, a copper silver (CuAg) wire having a pre-applied tin application or a wire having an alloy formed of a high tensile strength such as, for example, bronze.

The inventive connection technology is deployable with both coil supports formed of plastic or synthetic material as well as with coil supports formed of ferrite and ceramic plates. The arrangement of the connection pegs can be as desired and can be accommodated to the respective usage purposes.

In the following description, an embodiment of the inductive miniature component of the invention is described in more detail with reference to the attached drawings.

DETAILED DESCRIPTION OF THE INVENTION

Figure 1:
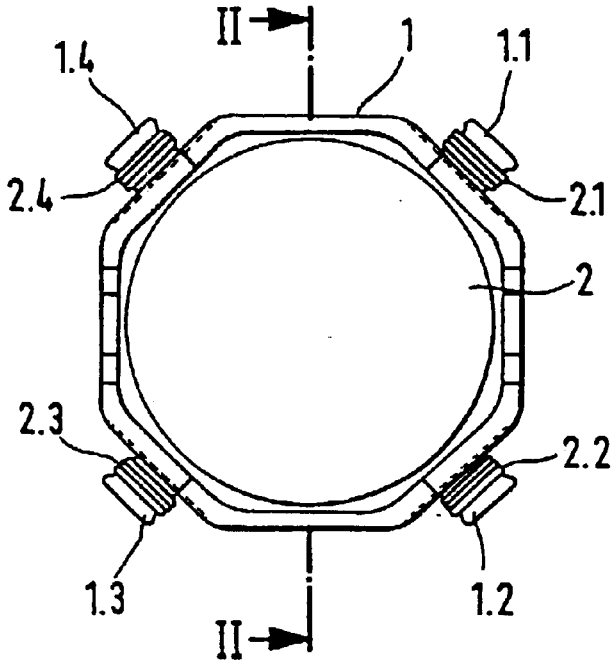
FIG. 1 is a plan view of an inductive miniature component which is configured as a transponder coil.
Figure 2:
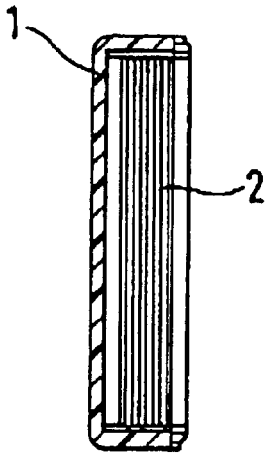
FIG. 2 is a view of the component shown in FIG. 1 in a sectional view thereof taken along lines II—II in FIG. 1.
Figure 3:
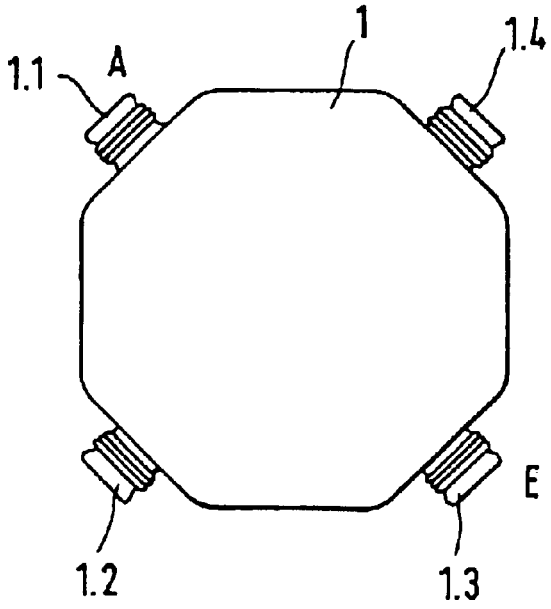
FIG. 3 is a view of the component shown in FIG. 1 as viewed from the bottom side of the component.
Figure 4:
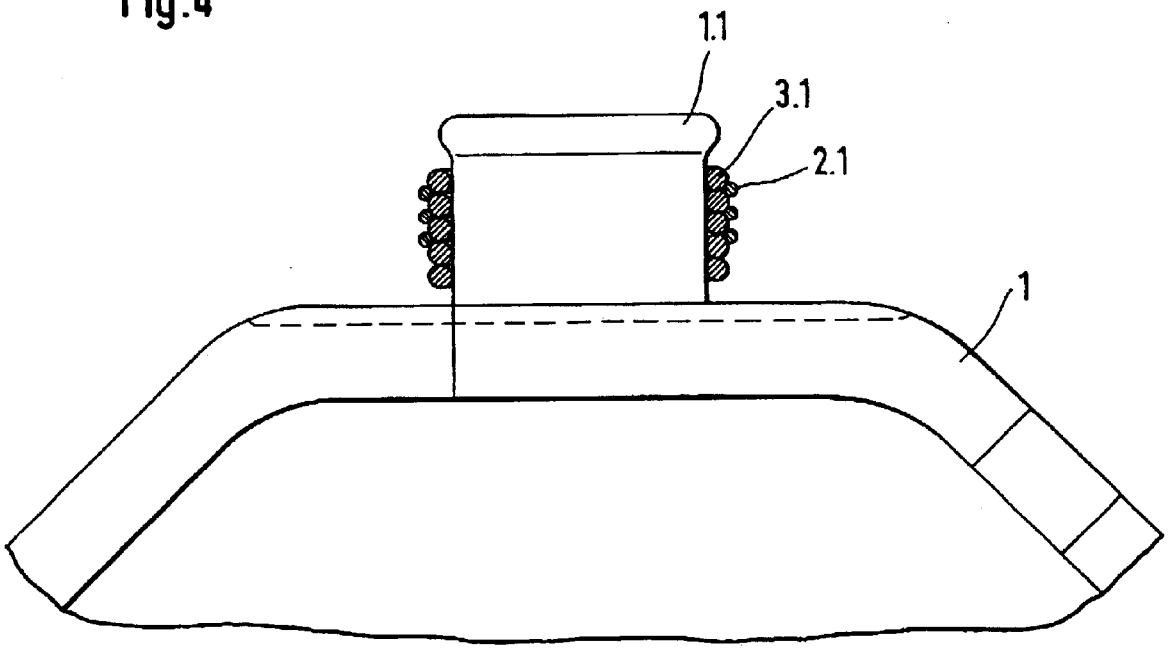
FIG. 4 is, in contrast to FIG. 1, an enlarged view of a portion of the component shown in FIG. 1 in the area of a connection peg thereof.

A transponder coil is shown in FIGS. 1–3 and comprises a coil support 1 configured as a cap, the coil support having a coil winding 2 disposed therein. The coil support 1 comprises an eight-cornered outline and is comprised of synthetic material. Connection pegs 1.1, 1.2, 1.3, and 1.4 are arranged on every second side surface of the coil support 1 and are integrally formed with the coil support. The connection pegs 1.1–1.4 are oriented in transverse directions to the coil support axis. Several turns of the ends 2.1–2.4 of the coil winding 2 are wound each around a respective one of the connection pegs 1.1–1.4. FIG. 4 shows details of this connection technology in connection with an example thereof of the connection peg 1.1. It can be recognized that a metallic wire winding 3.1 is disposed between the outer surface of the connection peg 1.1 and the windings 2.1, the metallic wire winding being comprised of an electrically conducting wire whose diameter is greater than the diameter of the winding 2.1 and several turns of the metallic wire winding being directly wound on the connection peg 1.1.

Figure 5:
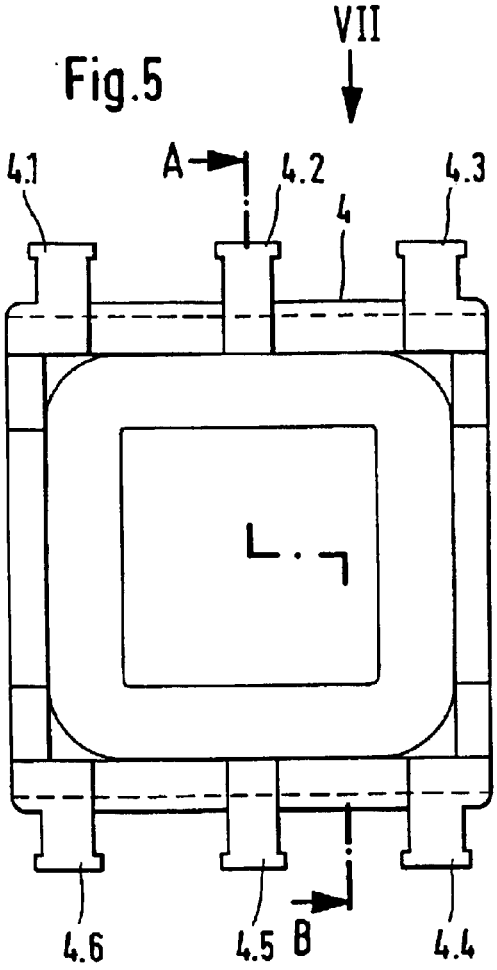
FIG. 5 is a view of the coil support configured as a cap of a miniature component without windings thereon.
Figure 6:
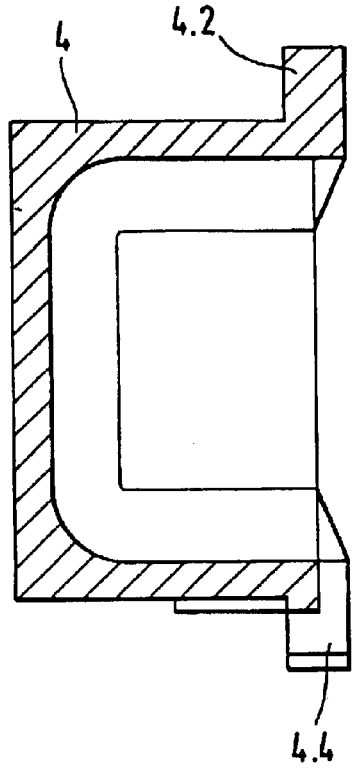
FIG. 6 is a sectional view through the coil support shown in FIG. 5 along the line A–B.
Figure 7:
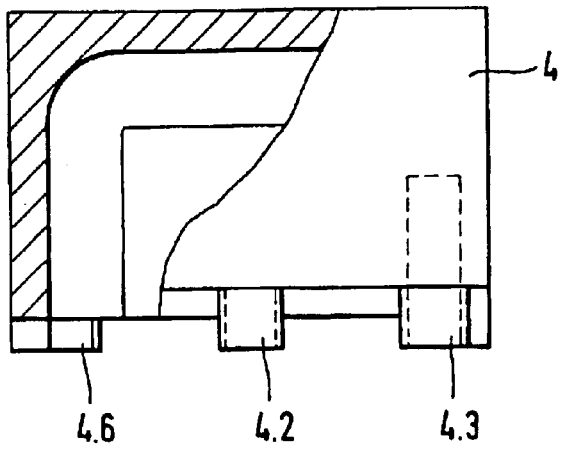
FIG. 7 is a partial sectional view of the coil support shown in FIG. 5 along the direction VII in FIG. 5.

This connection technology can also be deployed with coil supports of other configurations. An example of this is shown in FIGS. 5–7. In this connection, a coil support 4, which is configured as a cap, has a right-angled outline and the connection pegs 4.1, 4.2, 4.3, 4.4, 4.5, and 4.6 are respectively arranged on two opposed side walls of the coil support 4. The connection of the non-illustrated ends of the winding wire and the likewise non-illustrated coil winding are effected in the same manner as those described with respect to FIG. 4.

Figure 8:
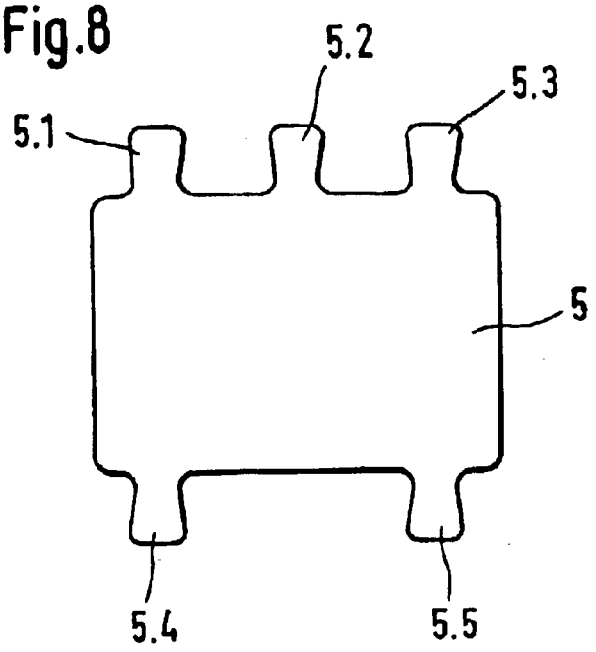
FIG. 8 is a view of a coil support configured as a ceramic plate for a double hole core transmitter.

A further example is shown in FIG. 8 of a coil support 5 which is configured as a ceramic plate for a double hole core transmitter and on whose opposed side surfaces connection pegs 5.1, 5.2, and 5.3 or, respectively, 5.4 and 5.5, are disposed. There follows, as well, the connection of the ends of a non-illustrated winding in the same manner as described in connection with FIG. 4.

Figure 9:
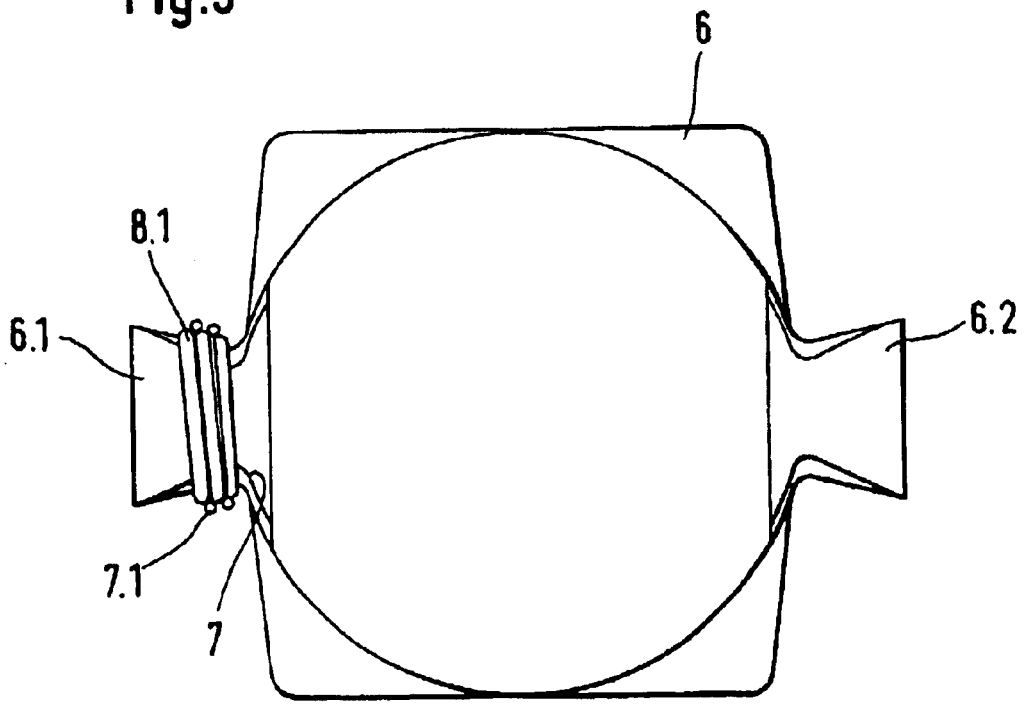
FIG. 9 is a view of a coil support configured as a ferrite wound body for an inductive component.

FIG. 9 shows a further possibility for the configuration of the coil support. The coil support 6 is configured in this connection as a ferrite wound body with two connection pegs 6.1 and 6.2 on opposed sides of the wound body. An end 7.1 of the only partially shown winding 7 is wound in several turns around the connection pegs 6.1, which have heretofore been wound with several turns of a metallic wire winding 8.1 whose wire has a diameter greater than the diameter of the winding wire.

The specification incorporates by reference the disclosure of German priority document DE 101 24 378.2 filed 18 May 2001 and PCT/DE02/01615 filed 3 May 2002.

The present invention is, of course, in no way restricted to the specific disclosure of the specification and drawings, but also encompasses any modifications within the scope of the appended claims.

What is claimed is:

1. An inductive miniature component for SMD-mounting, comprising:

a coil support formed of at least one of a synthetic and a ferrite material;

at least one coil winding disposed at a selected one of a disposition in the coil support and a disposition on the coil support, the coil support having a plurality of outwardly projecting connection pegs arranged on an outer side of the coil support, each connection peg having several turns of an end of a respective winding wire of a coil wire wound therearound; and a plurality of metallic wire windings each disposed between the outer surface of a respective one of the connection pegs and the several turns of the end of a respective one of the winding wires wound around the respective connection peg, each metallic wire winding being comprised of an electrically conducting wire whose diameter is greater than the diameter of the winding wire, and several turns of each metallic wire winding being directly wound on the respective connection peg.

2. An inductive miniature component according to claim 1, wherein the diameter of the wire of each metallic wire winding is at least twice as large as the diameter of the winding wire of the coil wire.

3. An inductive miniature component according to claim 1, wherein the wire of the metallic wire winding is a copper silver (AgCu) wire.

4. An inductive miniature component according to claim 1, wherein the coil support is configured as a cap in which the coil winding is disposed, and wherein the connection pegs are arranged on the side walls of the coil support and are oriented in transverse directions to the coil support axis.

5. An inductive miniature component according to claim 4, wherein the cap has a substantially right-angled outline and the connection pegs are respectively arranged on two opposed side walls of the cap.

6. An inductive miniature component according to claim 4, wherein the cap has a substantially eight-cornered outline and the connection pegs are arranged on every second side surface of the cap.

7. An inductive miniature component according to claim 4, wherein the cap has a round outline.

8. An inductive miniature component according to claim 1, wherein the coil support is configured as a ceramic plate.

9. An inductive miniature component according to claim 1, wherein the outwardly projecting connection pegs arranged on the outer side of the coil support are formed with the coil support as a single piece.

10. An inductive miniature component according to claim 1, wherein each of the plurality of metallic wire windings forms a wide metallic surface onto which the several turns of the end of a respective one of the winding wires is wound.

11. A method for producing an inductive miniature component for SMD-mounting, comprising:

winding of the outwardly projecting connection pegs of a coil support with several turns of a metallic wire winding;

disposing a coil winding in a selected one of a disposition in the coil support and a disposition on the coil support, the coil winding being formed of coil winding wire, the diameter of the metallic wire winding being greater than the diameter of the coil winding wire; if a lacquer insulation is present on an end of the coil winding wire, removing the lacquer insulation on the end of the coil winding wire;

optionally pre-applying tin to the end of the coil winding wire;

winding the connection pegs having the metallic wire winding wound therearound with several turns of the end of the coil winding wire of the coil winding; and placing the end of the coil winding wire of the coil winding in contact with the connection pegs via a selected one of dip brazing and a contact configuration that does not comprise dip brazing.

12. A method for producing an inductive miniature component according to claim 4, wherein disposing a coil winding in a selected one of a disposition in the coil support and a disposition on the coil support in the coil support includes disposing the coil winding in the coil support.

13. A method for producing an inductive miniature component according to claim 11, wherein disposing a coil winding in a selected one of a disposition in the coil support and a disposition on the coil support in the coil support includes disposing the coil winding on the coil support.

* * * * *